United States Patent [19]

Lecrone

[11] 4,031,791

[45] June 28, 1977

[54] KNIFE MOUNTING UNIT FOR ROLL SLICING MACHINE

[76] Inventor: Dale S. Lecrone, 4447 Bonnymede, Jackson, Mich. 49201

[22] Filed: Sept. 16, 1976

[21] Appl. No.: 723,917

[52] U.S. Cl. ..... 83/508.2; 83/4; 83/700

[51] Int. Cl.² ..... B26D 3/08; B26D 4/76

[58] Field of Search ..... 83/4, 499, 504, 433, 83/700, 508.1, 508.2, 508.3

[56] References Cited

UNITED STATES PATENTS

| | | | |
|---|---|---|---|
| 2,669,269 | 2/1954 | Schmidt | 83/4 |
| 2,686,542 | 8/1954 | Schmidt | 83/4 |

*Primary Examiner*—J. M. Meister
*Attorney, Agent, or Firm*—C. Hercus Just

[57] ABSTRACT

A roll slicing machine in which disc knives are fixed to one end of vertical shafts inserted in driving sleeves supported in bearing blocks on the machine is provided with a chuck unit connected to the upper end of the driving sleeves, above the bearing blocks, and said chuck units each comprise a head secured to the upper end of said driving sleeves and having a bore complementary to the upper ends of the knife shafts. The upper ends of the knife shafts are provided with a notch in one side thereof which is wider and deeper at one end than the other and said heads are provided with a transverse bore which receives a plug for axial movement of a frusto-conical section on said plug into and out of wedging engagement with said notch in said knife shaft with which said secton is substantially complementary in shape. Several embodiments of actuating structures are provided for moving said plug into and out of said wedging engagement of the frusto-conical sections with said notches in said knife shafts.

9 Claims, 7 Drawing Figures

KNIFE MOUNTING UNIT FOR ROLL SLICING MACHINE

BACKGROUND OF THE INVENTION

In recent years, it has become increasingly popular for bakeries to furnish particularly circular rolls known as hamburg rolls and elongated finer-like rolls known as hot dog or frankfurter rolls in pre-sliced condition in which the rolls have a small unsliced portion along one side which constitutes a hinge-like connection between the upper and lower sections of the pre-sliced rolls. Due to the different thicknesses and diameters or widths of these various rolls which are usually sold in clusters in which a predetermined number of said rolls are detachably connected together in certain side edges thereof, it is necessary that the knives on roll slicing machines must be adjusted relative to the positions thereof in the machines with respect to each other. At present, it is conventional to employ circular disc knives which are relatively thin and have very sharp perpheries, said perpheries frequently being serrated to enhance the cutting action of the knives, particularly incident to slicing freshly baked rolls which are in quite soft condition.

One type of roll slicing machine of the type to which the present invention pertains, which also illustrates the nature of the machines referred to above, comprises U.S. Pat. No. 3,911,769, issued Oct. 14, 1975, to the applicant of the present invention. In said patent, it will be seen that a plurality of knives of the type referred to are supported in bearing blocks which receive the shafts of the knives and pulleys are connected to the shafts for purposes of permitting an endless belt which extends around the plurality of such pulleys to drive the disc knives on the shafts in desired rotary direction incident to slicing rolls fed to said knives along fixed paths upon an endless conveyor. Positioning belts also are employed which move longitudinally of the direction of movement of the rows of roll clusters and engage the upper surfaces thereof respectively on opposite sides of the shafts of the slicing knives to hold the rolls positioned upon the feed conveyor while the same are being sliced by the knives.

It can be visualized from said machine, for example, in adapting the machine to slice respectively either circular hamburg type rolls or elongated frankfurter rolls, the spacings between the shafts of the knives must be varied. Similarly, some bakeries produce rolls which are thicker than those produced by other bakeries and in order to slice said rolls at the desired vertical location intermediately between the top and bottom surfaces of the rolls, it is necessary that the machine must be provided with means to adjust the knives vertically with respect to the feed belt and this is accomplished usually by mounting said shafts within tubular drive sleeves upon which the drive pulleys are fixed and set screws are threaded through the walls of the drive sleeves for receiving the set screws which engage the shafts of the knives which are mounted within said sleeves. Vertical adjustment of the shafts within said sleeves is accomplished usually by raising the cutting head from the feed conveyor so as to readily expose the circular knives for access either for removal and replacement of the knives such as when the same became dull or to adjust the vertical position thereof relative to the feed belt. Normally, it is not often that the vertical position of the knives needs to be adjusted but when any of the knives are removed and are replaced by resharpened knives for example, it is necessary that the knife be mounted within the drive sleeve at the required vertical position relative to the feed conveyor.

Various types of transverse adjustments of the knife shaft also are provided as illustrated and described in said aforementioned patent but such transverse adjustment does not comprise part of the present invention, which mainly is concerned with means to quickly remove and replace the disc knives and the shafts thereof with respect to the drive sleeves that support the same in the machine.

SUMMARY OF THE INVENTION

It is one of the principal objects of the invention to provide in a roll slicing machine mounting means for a knife shaft upon one end of which a disc type knife is fixedly connected and the shaft extends through a tubular driving sleeve which extends vertically through a bearing block for rotatable support thereby, the sleeve being driven by a pulley connected to the upper end thereof and mounted on the upper end of the sleeve is a chuck unit comprising a head having a first bore to receive the upper end of the driving sleeve in a manner to permit axial adjustment for variable spacing of the disc blade above the feed belt of the slicing machine and said head also having a second bore in the upper portion thereof, the diameter of second bore being complementary to the diameter of the knife shaft and said bore receiving the same co-axially, and said head being provided with a transverse bore to receive a latching plug movable axially within said bore and having a frusto-conical section complementary to the surface of a notch formed in one side of the upper end portion of the knife shaft, whereby when said plug is moved axially in one direction, said frusto-conical section wedgingly engages said notch of the knife shaft and firmly but disengageably connects the same to the driving sleeve through the medium of said chuck unit.

Ancillary to the foregoing object, it is a further object to form said notch in one side of the upper end of the knife shaft in a manner such that on end thereof is wider and deeper than the opposite end, thereby conforming the shape of said notch substantially to a portion of the frusto-conical section of the latching plug.

Another object of the invention is to provide two embodiments of means to move the latching plug in a direction to effect such wedging engagement of the frusto-conical section thereof with the notch in said knife shaft, one embodiment employing screw threads on the plug and in the transverse bore for operation by wrench means and the second embodiment comprising a spring-pressed button arrangement wherein the spring urges the plug in wedging direction but inward movement of the button disengages the latching plug from the shaft to permit axial removal of the shaft from the driving sleeve.

Details of the foregoing objectives and of the invention, as well as other objects thereof, are set forth in the following specification and illustrated in the accompanying drawing comprising apart thereof.

DETAILED DESCRIPTION

Figure 1:
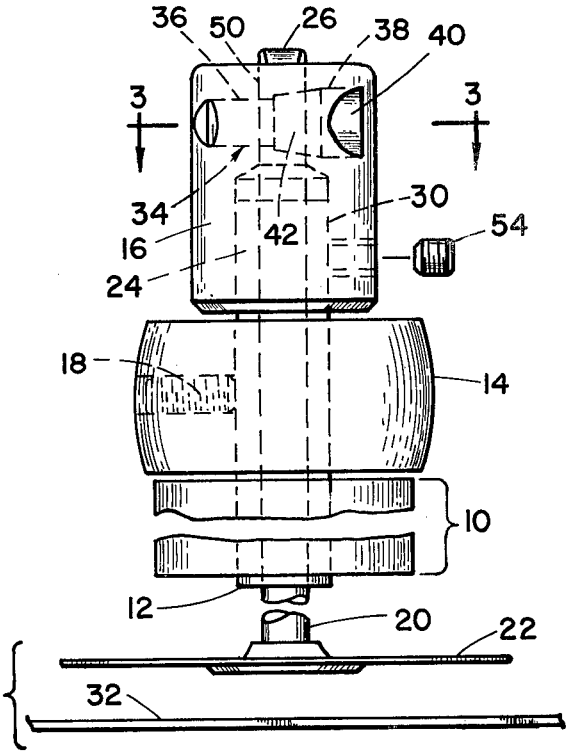
FIG. 1 is a side elevation illustration in vertically foreshortened manner a typical mounting means for the disc blades of a roll slicing machine and in which the chuck unit comprising the principal feature of the present invention is illustrated in the upper portion thereof.

Referring to FIG. 1, a vertical bearing block 10 is shown in vertically foreshortened manner to accommodate the view to the sheet, being understood that said bearing block is similar to those shown in the applicant's aforementioned prior patent. Any appropriate type of bearings may be employed within said block, preferably of an anti-friction nature for purposes of supporting therein for rotation a driving sleeve 12 which projects at one end from the lower end of the bearing block 10 and at the upper end thereof, the same projects an adequate distance to receive a driving pulley 14, and the lower portion of the head 16 of a chuck unit which embodies one of the principal features of the present invention. The pulley 14 is fixed for rotation of the sleeve 12 by an appropriate set screw 18, or any other appropriate means such as a key, spline, and the like, as desired, may be employed in place of said set screw. Also, appropriate means of conventional nature, not shown, are also employed to maintain the driving sleeve 12 within the bearing block 10 against axial movement in either direction, for purposes to be described.

Figure 2:
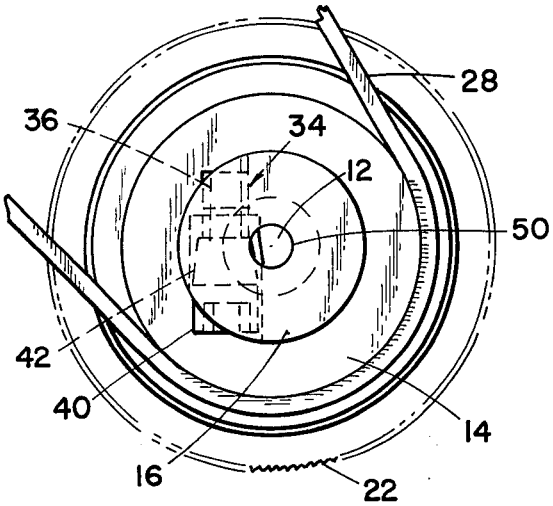
FIG. 2 is a fragmentary top plan view of the blade mounting means shown in FIG. 1.

The driving sleeve 12 is provided with a central bore closely complementary to the outer diameter of a knife shaft 20, which is of uniform diameter throughout, and fixed to the lower end of the shaft 30 is a disc knife 22 of conventional type such as employed in roll slicing machines of the type to which the present invention pertains. As can be seen from FIG. 1, the upper end portion 24 of driving sleeve 12 extends a limited distance above the upper end of driving pulley 14 and the upper end 26 of shaft 20 extends an appreciable distance above the upper end 24 of sleeve 12. Referring to FIG. 2, it will be seen that the pulley 14 is illustrated with a fragmentarily illustrated section of a driving belt 18 extending part way around said pulley.

Figure 3:
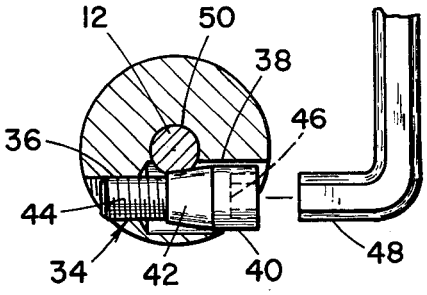
FIG. 3 is a transverse sectional view of one embodiment of latching means mounted within the head of the chuck unit shown in FIGS. 2 and 3 as seen on the line 3—3 of FIG. 1 and showing fragmentarily one end portion of wrench means by which the latching plug is operated in said embodiment.

The principle feature of the present invention comprises the chuck unit of which the head 16 is the basic element. As shown in FIG. 1, the lower portion of the head 16 is provided with a first bore 30 which has a diameter complementary to that of the upper end of the driving sleeve 12 and receives said upper end of the driving sleeve in a manner to provide limited vertical, axial adjustment with respect to the upper end of said driving sleeve for purposes of adjusting the distance between the disc knife 22 and the feed conveyor 32 of a typical roll slicing machine, said feed conveyor being illustrated only in fragmentary manner. While the vertical adjustment of the knife shaft 20 and the disc knife 22 is an important feature of the present invention, an even more important feature comprises the means by which the upper end portion of the knife shaft 20 is connected, preferably in a wedging manner as described hereinafter, to the head 16. Several embodiments of the means to effect such wedging connection are provided by the present invention, the first of these embodiments being illustrated in FIGS. 1-3 and in which it will be seen, particularly from FIG. 3, that the upper portion of the head 16 is provided with a transverse bore 34 which actually comprises two diameters, one of these being smaller than the other. The smaller diameter 36 is internally threaded and the larger diameter section 38 is preferably smoothly cylindrical. A latching plug 40 is provided in this embodiment of the invention, said plug having a frusto-conical section 42 and a short shaft 44 extends axially from the smaller end of the section 42. Said short shaft 44 is threaded in complementary manner to the internal threads of the bore 36. The opposite end of latching plug 40 is smoothly cylindrical and is provided with wrench-engaging means. In the particular illustration shown in FIG. 3, it will be seen that said wrench-engaging means comprises an Allen socket 46 for engagement by one end of the Allen wrench 48 which is shown in fragmentary manner in FIG. 3. It also will be observed from FIGS. 2 and 3 that the axis of the transverse bore 34 is latterly off set from the vertical axis of a second bore 50 which is smoothly cylindrical and is complementary to the outer diameter of knife shaft 20 so as to receive the same readily by axial movement when inserting the knife 22 and its shaft 20 within the machine.

Figure 6:
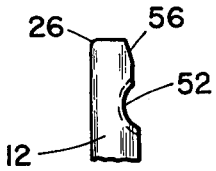
FIG. 6 is a fragmentary side elevation of the upper end of the knife shaft and illustrating the preferred shape of the arcuate notch formed in one side of said shaft.
Figure 7:
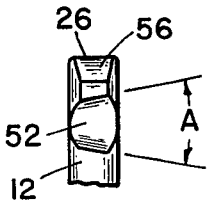
FIG. 7 is a view similar to FIG. 6 but showing the notch as viewed from the side face thereof and illustrating the greater width of one end of said notch than the other.

The upper end portion 26 of the knife shaft 12 is provided with an arcuate notch 52 in one side thereof, said notch being best illustrated in FIGS. 6 and 7. Particularly from FIG. 7, it will be seen that said notch is wider at one end than the other, whereby the opposite sides of said notch are disposed at an angle A with respect to each other. From FIG. 6, it also will be seen that not only is the notch 52 wider at one end than the other but it also is deeper at the wider end than at the narrower end of said notch. Said contour of the notch 52 is substantially the same as a portion of the frusto-conical section 42 of the latching plug 40 such as when the frusto-conical section 42 is disposed in wedging and firmly clamping engagement with the notch 52 in shaft 12, such as in the exemplary illustration shown in FIG. 3. Such wedging and locking engagement is made firm by use of the wrench 48, whereby it will be seen that by such connection, the shaft is rendered firmly connected to the driving sleeve 12 which, as described above is already made fast to the head 16 by means of set screw 44, for example, shown in somewhat exploded manner in FIG. 1. Further, to facilitate the insertion of the upper end of the shaft 20 into the lower end of driving sleeve 12 such as when initially mounting the knife in the machine, the upper end 26 of shaft 12 is preferably provided with a beveled face 56 which assists in the initial insertion of said upper end of the shaft in the lower end of the bore of driving sleeve 12.

Figure 4:
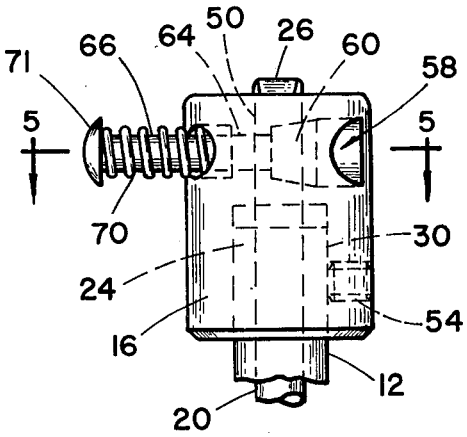
FIG. 4 is a fragmentary side elevation illustrating another embodiment of latching means in the chuck unit shown in FIGS. 1 and 2, said unit employing spring means by which the latching plug is maintained in wedging engagement with the upper end of the knife shaft.
Figure 5:
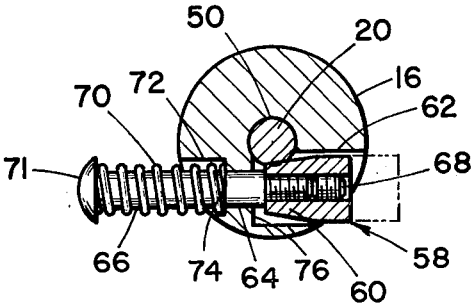
FIG. 5 is a transverse sectional view of the latching unit shown in FIG. 4 as seen on the line 5—5 thereof.

A second embodiment of latching means provided by the invention requires no tools to operate the same, details of this embodiment being shown in FIGS. 4 and 5. In this second embodiment of the invention, the latching plug 58 is slightly different from the latching plug 42 of the first embodiment functions similarly in that the plug 58 also is provided with a frusto-conical section 60 which has a cylindrical outer end which is complementary in shape to an outer portion 62 of a compound transverse bore, the axis of which also is latterly off set from that of the second bore 50 in the head 16. Another section of the compound bore in the embodiment of head 16 shown in FIGS. 4 and 5 is a smooth cylindrical section 64 which is smaller in diameter than the outer portion 62 of the bore for purposes of receiving a short shaft 66 which is threaded at one end into complementary threads formed in a bore in the frusto-conical section 60 of the latching plug 58, as best shown in FIG. 5, and a threaded locking plug 68 is also threaded into said bore to abut the extremity of the threaded end of short shaft 66 to lock the same to the frusto-conical section 60.

A coiled compression spring 70 surrounds the short shaft 66. the outer end of said shaft being provided with a manually engageable button 71. The compound bore in the head 16 of FIGS. 4 and 5 also is provided with another, outer section 72, the inner end of which provides a seat 74, see FIG. 5, against which the spring 71 abuts and the opposite end of said spring abuts the inner surface of button 71.

The spring 71, when installed, is placed under a limited amount of compression to insure that when the frusto-conical section 60 of the latching plug 58 engages the notch 52 in the upper end of the knife shaft 12, as illustrated for example in exemplary showings in FIGS. 4 and 5, there will be sufficient outward force placed upon the short shaft 66 that it will cause the frusto-conical section 60 which is connected thereto to firmly and wedgingly engage the arcuate notch 52 of the knife shaft and thus securely latch the same to the head 16 of the chuck unit. Simply by pressing inwardly upon the button 71, it is possible to disengage the frusto-conical section 60 of the latching plug 58 from the notch 52 in the knife shaft and thereby permit the shaft and the blade thereon to be removed slidably from the lower end of the driving sleeve 12 and when the button 71 is released following such removal of the knife shaft, the inner end of the frusto-conical section 60 of the latching plug 58 will engage another shoulder 76 at the inner end of bore 62 as shown in FIG. 5. The threaded engagement between the short shaft 66 and the frusto-conical section 60 facilitates the assembly and installation of the latching plug with respect to the head 16.

From the foregoing, it will be seen that the present invention provides a plurality of embodiments of chuck unit of a simple but highly effective nature for purposes of quickly connecting and latching the shaft of a disc knife in a slicing machine in its operative position relative to the driving sleeve within which it is supported. The operation of the frusto-conical sections of either of the embodiments of latching means operates to quickly, firmly and accurately locate the shaft of the knife within its driving sleeve and also secure the shaft against relative rotation with respect to said sleeve after the wedge type latching means have been secured in operative position with respect to the knife shaft. Further, the head of the chuck unit is capable of being vertically adjusted with respect to the driving sleeve and the feed conveyor 32 and dispose the knife at a desired spacing above said feed conveyor upon which the rolls to be sliced are supported and fed to the knife means. Such adjustment is secured by simple set screw means or the equivalent thereof and, in the majority of types of operation of slicing machines of this type, it is seldom necessary to vertically adjust the knivs with respect to the feed conveyor. One of the principal objectives of the present invention is to facilitate the removal of knives and the shafts thereon from the machine such as when a knife is to be replaced with a resharpened one or otherwise and then reinstall the knife shaft accurately in a longitudinal manner with respect to the driving sleeve that receives the same, the latching of the shaft within the sleeve being accomplished quickly and accurately. One embodiment requires only the manipulation of a simple wrench and the second embodiment requires the use of no tools whatever.

The foregoing description illustrates preferred embodiments of the invention. However, the concepts employed may, based upon such description, be employed in other embodiments without departing from the scope of the invention. Accordingly, the following claims are intended to protect the invention broadly, as well as in the specific forms shown herein.

I claim:

1. A disc blade mounting and driving unit for a roll slicing machine comprising in combination, a normally vertical driving sleeve supported for rotation about the axis thereof within bearing means, a drive pulley fixed to the upper end of said sleeve, a knife shaft coaxial with said sleeve and extending respectively at the opposite ends thereof beyond the opposite ends of said sleeve and a disc knife fixed to the lower end of said shaft; the improvement comprising a chuck unit comprising a head having a first bore in one end to receive the upper end of said driving sleeve coaxially, means to firmly secure said head to said upper end of said driving sleeve, the opposite end of said head having a second bore coaxial with said first bore and of a diameter complementary to that of said knife shaft and receiving the upper end of said shaft, said shaft having an arcuate notch in one side thereof adjacent the upper end and extending transversely to the axis of said shaft and said notch being wider at one end than the other, said head having a bore extending transversely thereof in the upper end portion thereof substantially coaxial with the axis around which said notch is generated, a latching plug mounted within said transverse bore for axial movement and having a frusto-conical section complementary to the surface of said notch and adapted to wedgingly engage said notch when said plug is moved in one direction to secure said shaft to said driving sleeve for rotation of said disc knife thereby, and means operable to move said latching plug into wedging engagement with said notch in said shaft.

2. The unit for a roll slicing machine according to claim 1 in which said means to move said latching plug into wedging engagement with said notch in said shaft comprises complementary threads on said plug and within said transverse bore in said head.

3. The unit for a roll slicing machine according to claim 2 in which said plug is provided with wrench-engaging means for movement of said plug between wedging and shaft-releasing positions.

4. The unit for a roll slicing machine according to claim 1 in which said notch in said upper end of said shaft also is deeper at the wide end thereof than at the narrower end to conform the same relatively closely to the portion of the frusto-conical surface of the plug which engages the same.

5. The unit for a roll slicing machine according to claim 1 in which said means to move said latching plug into wedging engagement with said notch in said shaft comprises a short coaxial shaft on one end of said plug projecting from the small end of said frusto-conical section of said plug, a coiled compression spring surrounding said shaft in limited compressed condition, one end of said spring abutting said head of said chuck unit, and means on said shaft adjacent the outer end thereof with which the opposite end of said spring engages, whereby said spring automatically maintains said plug in wedging engagement with said notch in said knife shaft and may be compressed when the outer end of said short shaft is moved by pressure in a direction to disengage said plug from said notch in said knife shaft to permit removal of said knife shaft from the machine.

6. The unit for a roll slicing machine according to claim 5 in which said means on the outer end of said short shaft comprises a button abutted by said opposite end of said spring.

7. The unit for a roll slicing machine according to claim 5 in which said head is provided with a seat in the outer end of said transverse bore therein complementary to the diameter of said spring, the portion of said bore extending inward from said seat being complementary in diameter to that of said short shaft, and the portion of said bore which receives said frusto-conical section of said plug having a uniform diameter complementary to the largest end of said section.

8. The unit for a roll slicing machine according to claim 1 in which said head is axially adjustable upon said upper end of said driving sleeve to effect adjustable vertical positioning of said knife shaft relative to the bearing means for said sleeve and thereby effect desired spacing of the knife on the shaft relative to the feed conveyor of a roll slicing machine.

9. The unit for a roll slicing machine according to claim 8 in which the lower portion of said head is provided with a tapped hole intersecting said first bore in said head, and a set screw is threaded in said hole for vertically adjustable securing of the head upon the upper end of said driving sleeve.

* * * * *